United States Patent [19]

Credle, Jr.

[11] Patent Number: 4,681,518

[45] Date of Patent: Jul. 21, 1987

[54] SINGLE-ACTING, GAS OPERATED PUMP

[75] Inventor: William S. Credle, Jr., Stone Mountain, Ga.

[73] Assignee: The Coca-Cola Company, Atlanta, Ga.

[21] Appl. No.: 811,863

[22] Filed: Dec. 20, 1985

Related U.S. Application Data

[63] Continuation-in-part of Ser. No. 702,515, Feb. 19, 1985, abandoned.

[51] Int. Cl.[4] ..... F04B 43/06

[52] U.S. Cl. ..... 417/395; 91/347

[58] Field of Search ..... 417/393, 395; 91/346, 91/347

[56] References Cited

U.S. PATENT DOCUMENTS

| | | | |
|---|---|---|---|
| 603,242 | 4/1898 | Weatherhead | 417/392 |
| 1,067,613 | 7/1913 | Lane | 417/395 |
| 2,028,371 | 1/1936 | Wiltse | 91/347 |
| 2,090,575 | 8/1937 | De Motte | 91/347 |
| 2,214,922 | 9/1940 | Ericson | 91/347 X |
| 2,506,434 | 5/1950 | Quimper | 417/395 |
| 2,658,485 | 11/1953 | Dreyer | 91/347 X |
| 2,711,134 | 6/1955 | Hughes . | |
| 2,780,177 | 2/1957 | Hoencke | 91/313 X |
| 3,000,320 | 9/1961 | Ring . | |
| 3,294,030 | 12/1966 | Fox . | |
| 3,299,826 | 1/1967 | Williams | 417/395 |
| 3,387,566 | 6/1968 | Temple | 417/403 |
| 3,771,907 | 11/1973 | Neuman et al. | 417/454 |
| 3,816,034 | 6/1974 | Rosenquest, Jr. | 417/395 |
| 4,334,838 | 6/1982 | Fessler et al. | 417/395 |
| 4,436,493 | 3/1984 | Credle, Jr. | 417/393 |

FOREIGN PATENT DOCUMENTS

| | | | |
|---|---|---|---|
| 515687 | 12/1939 | United Kingdom | 91/347 |

*Primary Examiner*—Leonard E. Smith

[57] ABSTRACT

A single-acting, gas operated, pump method and apparatus including a pump body having a main chamber divided by a reciprocating piston assembly into a gas driving chamber and a liquid pumping chamber, a spring for biasing the piston assembly into one of its two end positions, a reciprocating control valve controlling the flow of driving gas to and from the gas driving chamber, a snap-acting spring mechanically coupling the control valve to the reciprocating movement of the piston assembly, and a counteracting spring for biasing the control valve toward one of its two positions.

37 Claims, 17 Drawing Figures

SINGLE-ACTING, GAS OPERATED PUMP

CROSS-REFERENCE TO RELATED APPLICATION

This is a continuation-in-part application of copending application of William S. Credle, Jr., Ser. No. 702,515, filed Feb. 19, 1985, now abandoned with the same title.

BACKGROUND OF THE INVENTION

1. Field of the Invention

This invention relates to a single-acting, gas operated, reciprocating pump for use in pumping syrup in a post-mix beverage dispensing system, and more specifically to such a pump that is inexpensive, quiet, that has no priming problem, that has an inherent sold-out feature, and that has little tendency to stall.

2. Description of the Prior Art

There are presently two general types of syrup pumps on the market. At one end of the spectrum are the double-acting, gas powered, diaphragm pumps, such as that shown in U.S. Pat. No. 4,436,493. These pumps work on demand and because they have a relatively long, slow stroke they prime very well. At the other end of the spectrum are fast cycling electric pumps. These pumps do not prime very well because they have relatively short, fast strokes. Electric pumps must be fitted with pressure switches before they can work on demand.

It is an object of the present invention to provide an inexpensive, gas-operated syrup pump.

It is another object of the present invention to provide an inexpensive, gas-operated syrup pump that has no priming problems.

It is a still further object of the present invention to provide a syrup pump that has an inherent sold-out feature.

It is another object of the present invention to provide a single-acting, gas operated pump that is sized to cycle at a rate of from about 0.5 to 15 cycles per second, and to dispense from about 0.25 to 0.5 ounces of syrup per second.

It is still another object of the present invention to provide a single-acting, gas operated reciprocating pump that includes a piston assembly stem that is mechanically coupled to the stem of the gas control valve by a snap-acting spring mechanism, and that includes a counteracting spring on the control valve stem.

SUMMARY OF THE INVENTION

The present invention comprises a single-acting, gas operated, reciprocating pump including a pump body having a main chamber separated by a piston assembly into a driving gas chamber and a liquid pumping chamber, spring means for biasing the piston assembly to one of its two end positions, check valves for feeding liquid one-way into and out of the liquid pumping chamber, a control valve for alternately feeding driving gas into the driving gas chamber under pressure and for exhausting gas therefrom to cause the piston assembly to reciprocate and to alternately pump liquid out of the liquid chamber and to draw liquid thereinto, respectively, a snap-acting spring mechanism coupling the reciprocating piston assembly to the control valve for snap moving the control valve means from one of its two end positions to the other in response to the reciprocating movement of the piston assembly, and a counteracting spring on the control valve stem.

BRIEF DESCRIPTION OF THE DRAWINGS

The present invention will be more fully understood from the detailed description set forth below, when read in conjunction with the accompanying drawings wherein like reference numerals represent like elements and wherein.

DETAILED DESCRIPTION OF THE PREFERRED EMBODIMENTS

Figure 14:
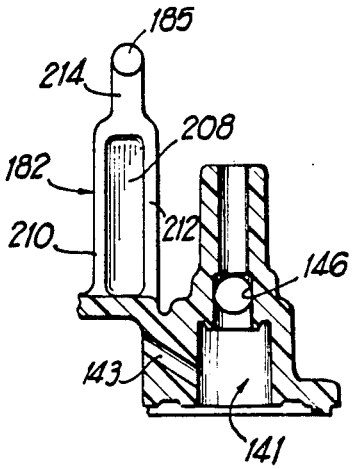
FIG. 14 is a side elevational view of the post of FIG. 12.
Figure 15:
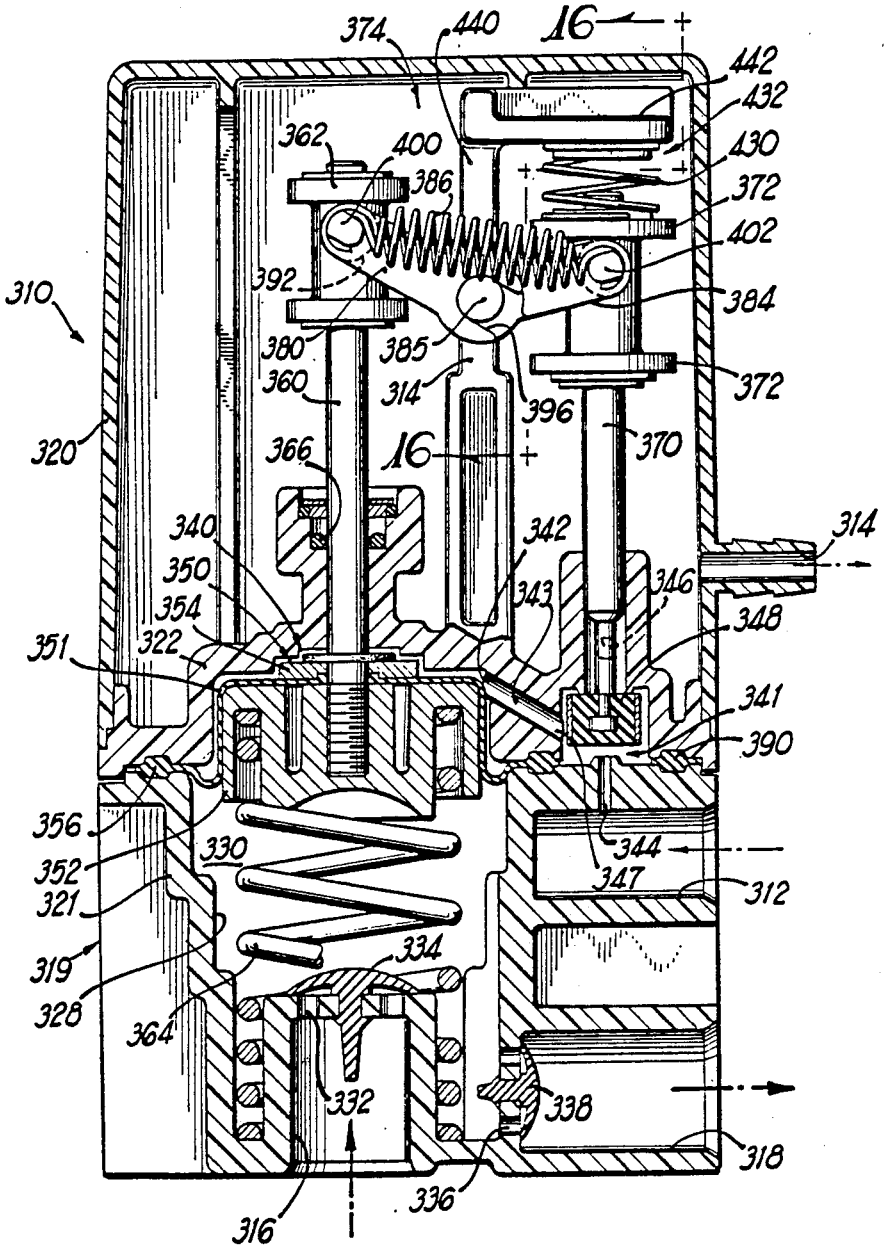
FIG. 15 is a cross-sectional side view of a preferred embodiment of a pump according to the present invention.
Figure 16:
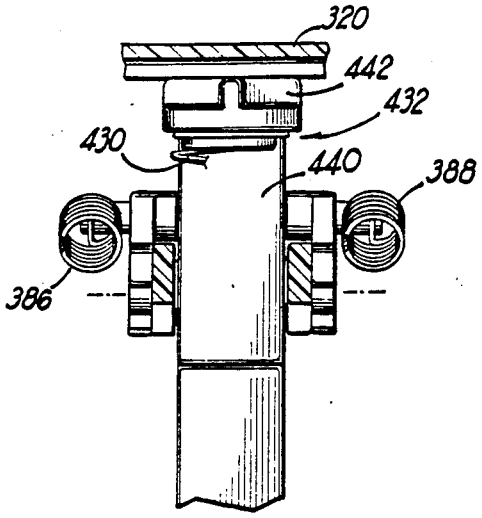
FIG. 16 is a partial elevational view taken along line 16—16 of FIG. 15.
Figure 17:
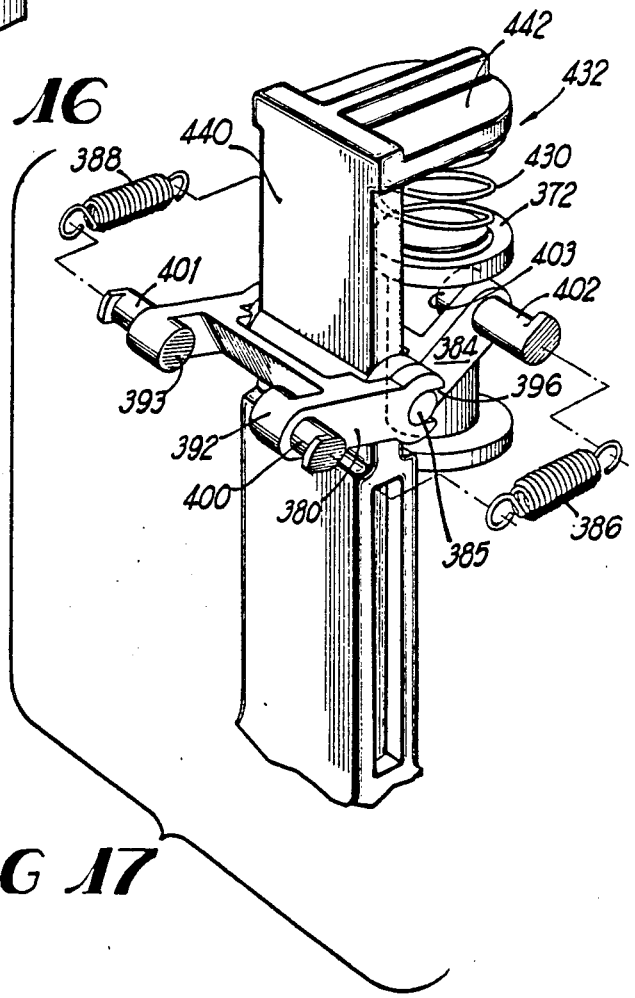
FIG. 17 is a partial perspective view of the supporting structure and counteracting spring of the pump of FIGS. 15 and 16.

With reference now to the drawings, FIGS. 1–7 show one embodiment of the present invention, FIGS. 8–14 show another embodiment of the present invention, and FIGS. 15–17 show a preferred embodiment of the present invention.

FIGS. 1–7 show a single-acting, gas operated, reciprocating pump 10 having a gas inlet fitting 12, a gas outlet fitting 14, a fluid inlet fitting 16 and a fluid outlet fitting 18.

The pump 10 includes a pump body 19 and a cover 20. The pump body 19 includes a lower body 21 connected to an upper body 22 by screws 24.

The pump body 19 has a main chamber 28 divided by a reciprocating piston assembly 50 into a liquid pumping chamber 30 and a driving gas chamber 40. The liquid chamber 30 has an inlet port 32 controlled by a one-way umbrella valve 34 and an outlet port 36 controlled by a one-way umbrella valve 38.

The gas chamber 40 has a gas chamber port 42 in communication by a gas passageway 43 with a control valve chamber 41. The control valve chamber 41 has a gas inlet port 44, a gas exhaust port 46, and an inlet-outlet port 47 in communication with the gas chamber 40 by means of the gas passageway 43. The control valve chamber 41 has a reciprocatable control valve 48 therein movable from a first position (shown in FIGS. 1, 4 and 5) closing the gas exhaust port 46 and providing flow communication between the gas inlet port 44 and the gas chamber 40, to a second position (shown in FIGS. 6 and 7) closing the gas inlet port 44 and providing communication between the gas exhaust port 46 and the gas chamber 40.

Figure 1:
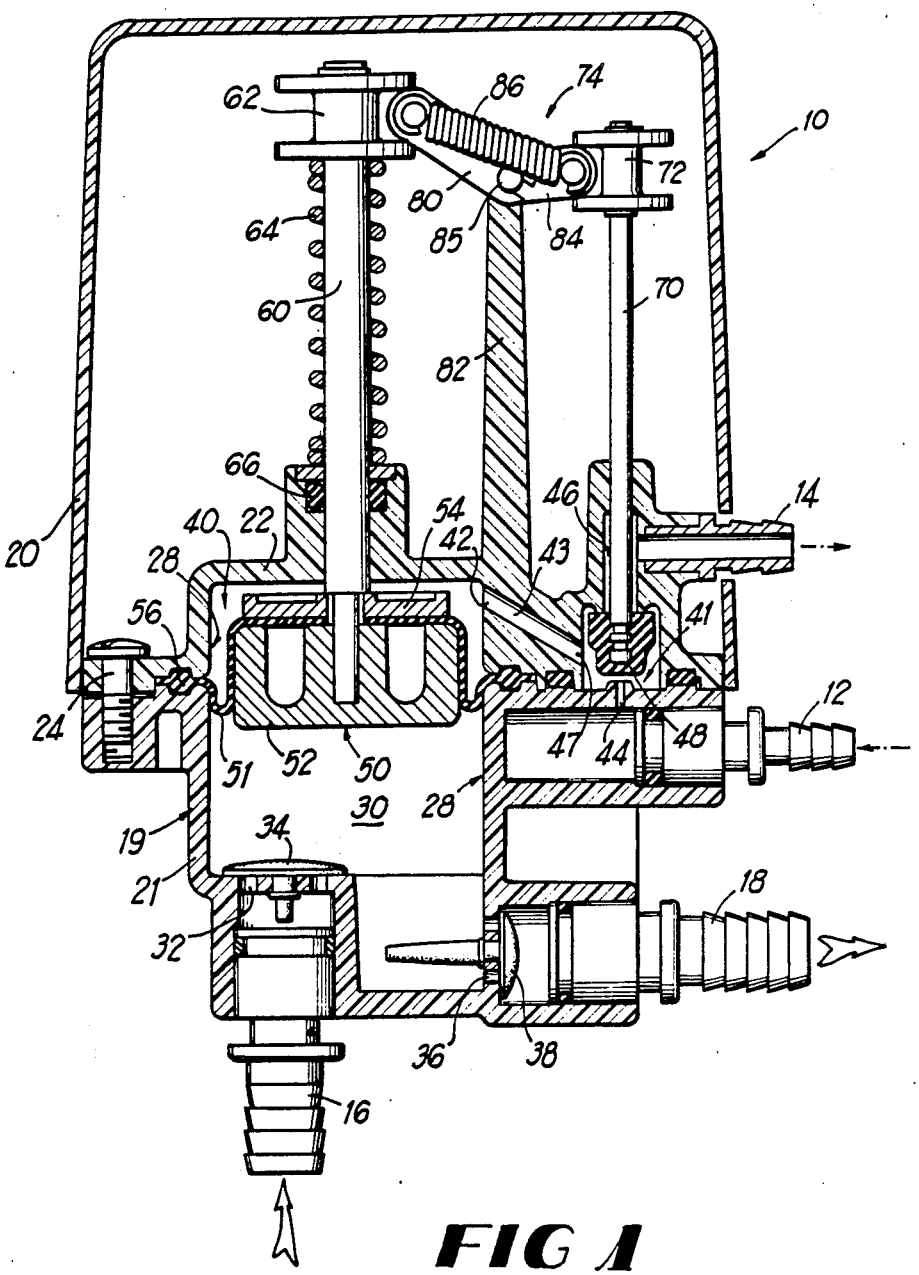
FIG. 1 is a cross-sectional side view of one embodiment of a pump according to the present invention.

The piston assembly 50 preferably includes a diaphragm 51 connected between a piston 52 and a retainer 54. The diaphragm 51 includes an annular bead 56 sealed in a pair of mating grooves between the upper and lower bodies 22 and 21, respectively. The piston 52 is connected to a piston stem 60 which has a piston stem collar 62 on its upper, distal end. An O-ring seals against the reciprocating stem 60. A compression spring 64 surrounds the stem 60 and biases the diaphragm assembly upwardly as shown in FIG. 1.

The control valve 48 is connected to the lower, proximal end of a valve stem 70 which has a valve stem collar 72 on its upper distal end.

Figure 2:
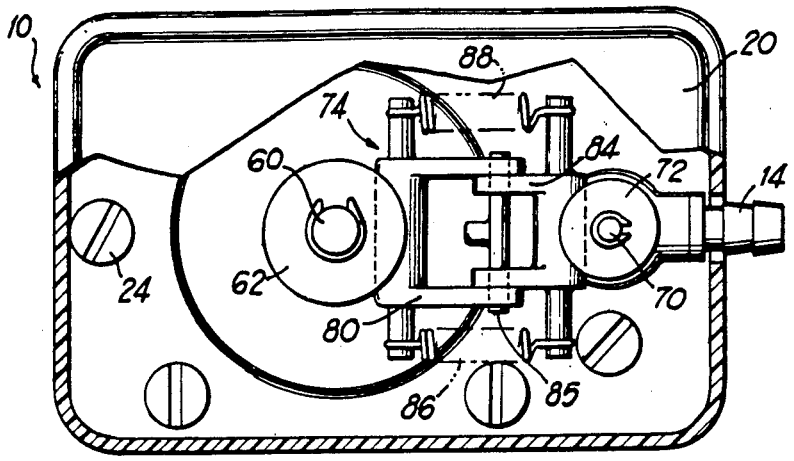
FIG. 2 is a partly broken-away, partly cross-sectional plan view of the pump of FIG. 1.
Figure 3:
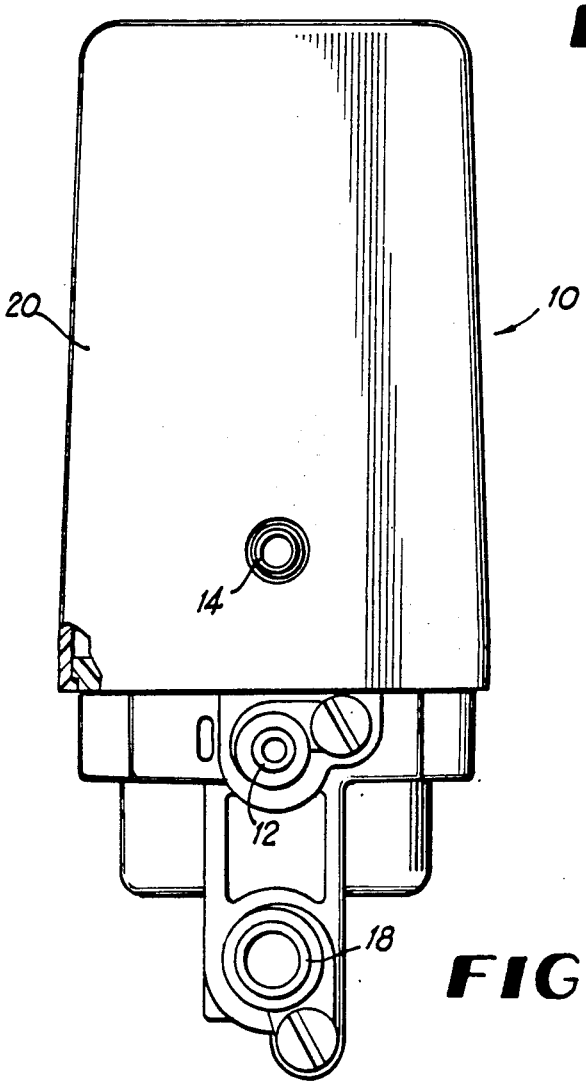
FIG. 3 is a rear elevational view of the pump of FIG. 1.

The piston assembly 50 and the control valve 48 are mechanically coupled together by an over-center, snap-acting spring mechanism 74. The spring mechanism 74 includes an upstanding post 82 located between the stems 60 and 70. A long arm 80 extends between the piston stem collar 62 and a cylindrical bar 85 on the top of the post 82, and a short arm 84 extends between the valve stem collar 72 and the bar 85. A pair of extension springs 86 and 88 extend between the arms 80 and 84 (as best shown in FIGS. 1 and 2).

The upper and lower bodies 22 and 20, respectively, of the pump 10 are preferably injection molded and held together by screws, although bolts or clamps or unltrasonic welding can be used. The cover 20 is preferably snapped on. The stem 60 is preferably screw-threaded to the piston 52 and the diaphragm 51 is sandwiched between the retainer 54 and the piston. The piston assembly or diaphragm assembly 50 can alternatively use a piston with a dynamic or other seal, or can use a diaphragm alone or with a number of upper and lower plates. The stem 70 is preferably snapped in a recess in the control valve 48.

Figure 4:
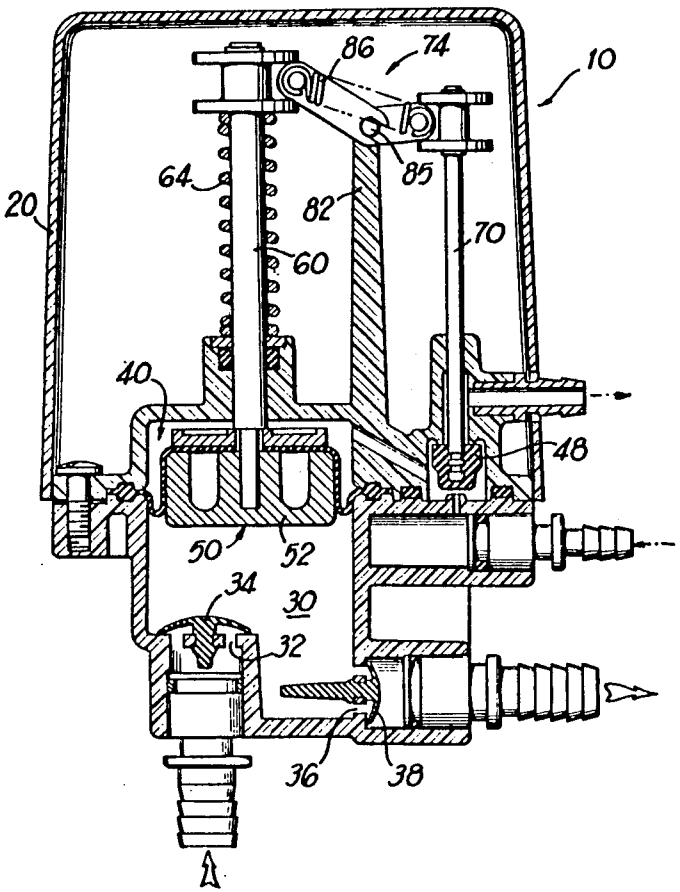
Figure 7:
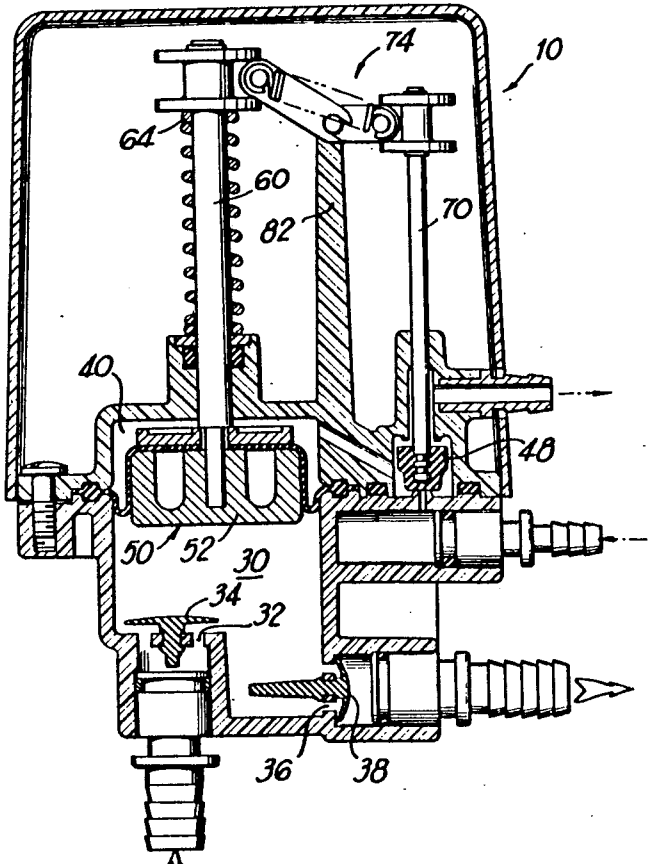
Figure 6:
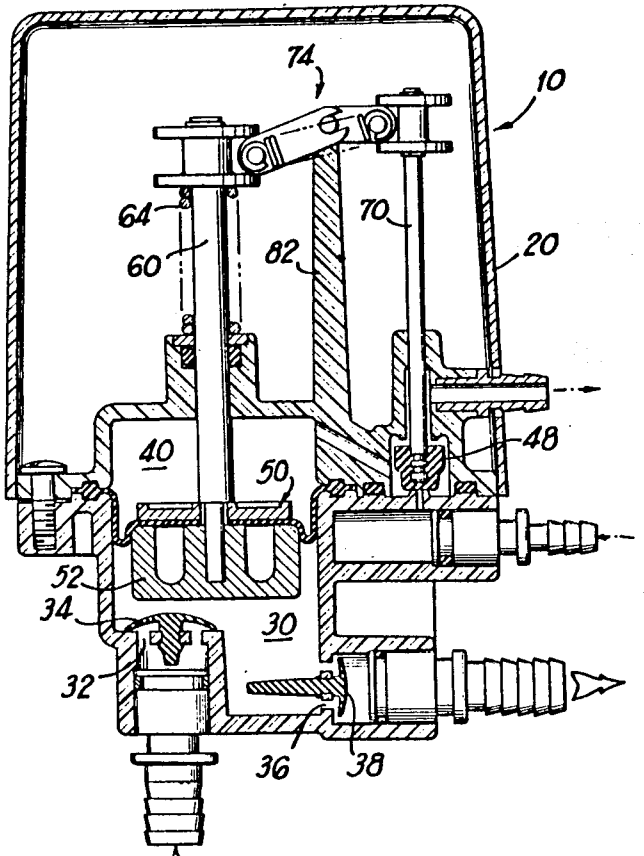
Figure 8:
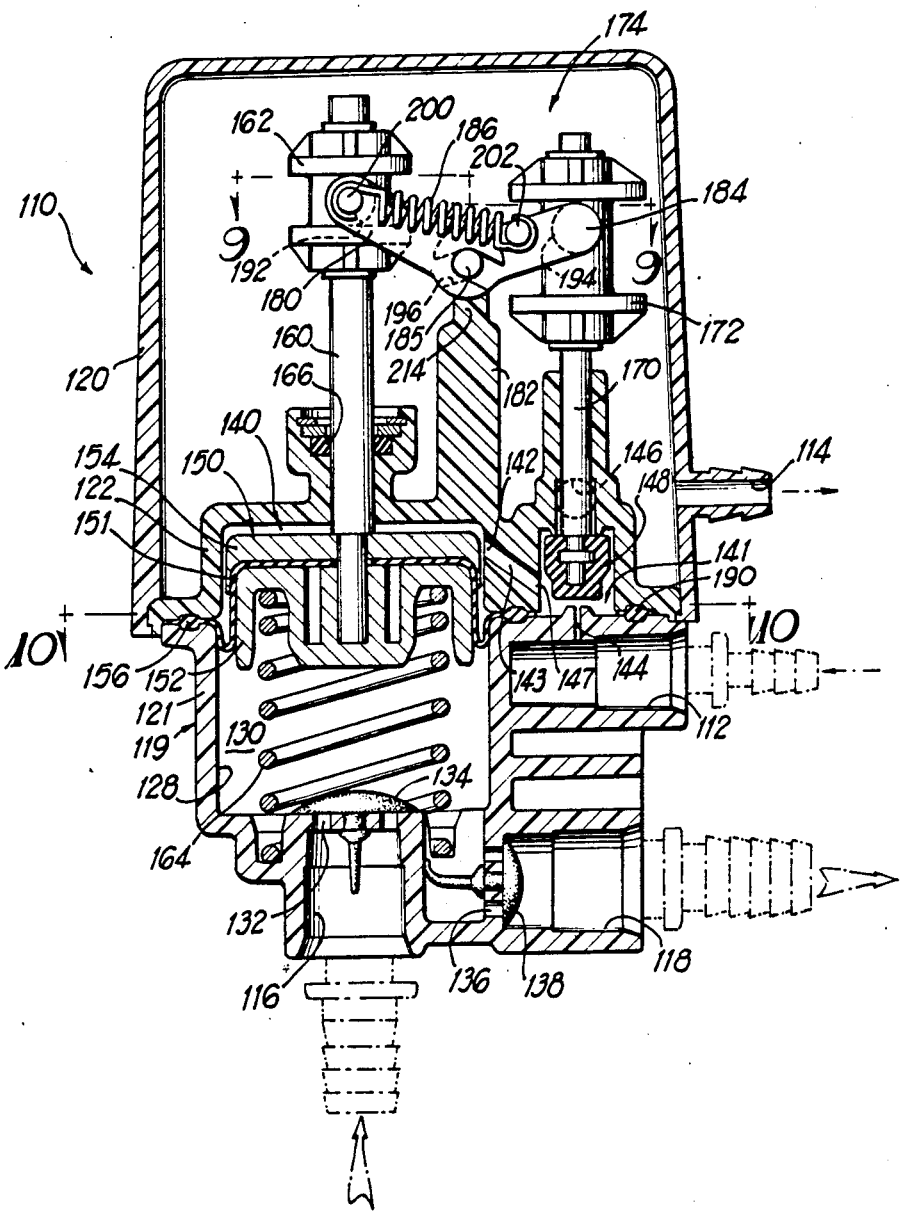
FIG. 8 is a cross-sectional side view of another embodiment of a pump according to the present invention.

The operation of the pump 10 is shown in FIGS. 4–7. FIG. 4 shows the at-rest condition of the pump 10. The gas inlet 12 is connected a source of gas under pressure, such as a $CO_2$ cylinder. A pressure regulator maintains the gas at a pre-set value of from about 30–75 psig. The liquid inlet fitting 16 is connected to a source of syrup, such as a bag-in-box. The liquid outlet fitting 18 is connected to a post-mix beverage dispenser, and through such dispenser to a beverage dispensing valve assembly.

Figure 5:
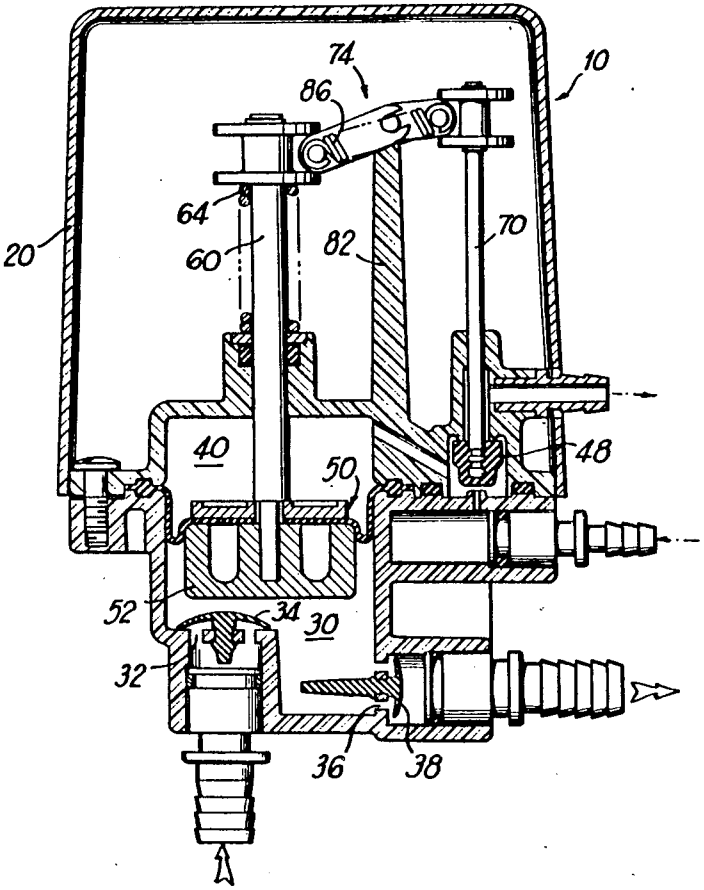
FIGS. 4–7 are cross-sectional side views similar to FIG. 1 and showing the operation of the pump.

When syrup is withdrawn from the liquid chamber 30 (when a beverage dispenser valve assembly is activated to dispense a mixture of syrup and carbonated water, for example) the gas pressure in the gas chamber 40 causes the diaphragm 50 to move downwardly as shown in FIG. 5. Toward the end of the downward travel of the diaphragm 50, the spring mechanism 74 moves over center and causes the control valve stem 70 to snap downwardly moving the control valve 48 downwardly to the position shown in FIGS. 6 and 7. This allows the gas in the gas chamber 40 to exhaust to atmosphere. When this happens, the compression spring 64 around the piston stem 60 snaps the piston assembly 50 upwardly and the snap-acting spring mechanism 74 then snap moves the control valve stem 70 upwardly moving the control valve 48 upwardly closing the exhaust port 46 to atmosphere and providing communication between the gas chamber and the source of pressurized gas, causing the cycle to repeat.

The pump 10 is sized so that it cycles at a rate of from about 0.5 to 15 cycles per second, when supplying syrup to a post-mix dispensing valve assembly. Tests show that this cycling rate is fast enough to ensure a relatively steady output but not so fast as to cause priming problems. When supplying syrup for a twelve (12) ounce beverage cup (which requires about two ounces of syrup), the pump will dispense about 0.3 fluid ounces of syrup per cycle and will cycle for from about 6 to 8 times for each such 12 ounce cup. Preferably about 0.5 cubic inches of syrup is dispensed each cycle. The pump 10 dispenses either about 0.25 or 0.5 ounces per second depending upon whether it is used with a valve assembly that dispenses a beverage at 1.5 ounces per second or at the faster rate of about 3.0 ounces per second. That is, the pump 10 will cycle about twice as fast when used with the faster valve assembly. The flow control in the valve assembly is one of the factors that determine the rate at which the pump 10 will cycle.

The maximum volume of the liquid chamber 30 is preferably about one (1) cubic inch. The control valve 48 preferably has a travel of about 0.06 inches. The diaphragm is preferably made of non-reinforced elastomer.

The spring 64 is preferably sized and has such a spring force that it will stall out when the pressure on the syrup side reaches about twenty-two (22) inches of mercury. That is, when the syrup supply is empty, and a vacuum is pulled of 22" hg, then the pump will stop working. This provides the pump 10 with an automatic, built-in syrup sold-out feature. Other values than 22" hg can be used. The preferred gas pressure for use in the pump 10 is about 60 psig.

It has been found that if the pump 10 operates at 0.5 to 15 cycles per second and dispenses from about 0.25 to 0.5 ounces of syrup per second, that priming problems will be avoided.

FIGS. 8–14 show another embodiment of the present invention of a pump 110 having a gas inlet port 112, a gas outlet port 114, a fluid inlet port 116 and a fluid outlet port 118.

The pump 110 includes a pump body 119 and a cover 120. The pump body 119 includes a lower body 121 and an upper body 122 connected together as by suitable screws (not shown).

The pump body 119 has a main chamber 128 divided by a reciprocating piston assembly 150 into a liquid pumping chamber 130 and a driving gas chamber 140. The liquid chamber 130 has an inlet port 132 controlled by a one-way umbrella valve 134 and an outlet port 136 controlled by a one-way umbrella valve 138.

The gas chamber 140 has a gas chamber port 142 in communication through a gas passageway 143 with a control valve chamber 141. The control valve chamber 141 has a gas inlet port 144, a gas exhaust port 146, and an inlet-outlet port 147 in communication with the gas chamber 140 by means of the gas passageway 143. The control valve chamber 141 has a reciprocating control valve 148 therein moveable from a first position (shown in FIG. 8) closing the gas exhaust port 146 and providing gas communication between the gas inlet port 144 and the gas chamber 140, to a second position (not shown) closing the gas inlet port 144 and providing gas flow communication between the gas exhaust port 146 and the gas chamber 140. In this embodiment, the gas exhaust port 146 opens into the inside of the cover 120 at a 90° angle to the gas outlet fitting 112 to provide a quieter operation by muffling the noise of the pump somewhat.

The piston assembly 150 includes a diaphragm 151 connected between a piston 152 and a retainer 154 and includes an annular bead 156 that seats in a pair of mating grooves in the upper and lower bodies 122 and 121, respectively. The piston 152 is connected to a piston stem 160 which has a piston stem collar 162 on its distal end. An O-ring 166 seals against the reciprocating stem 160. A compression spring 164 is positioned in the liquid pumping chamber 130 between the piston 152 and the lower body 121. An annular groove in each of the piston and lower body receives the spring 164. The spring biases the piston assembly upwardly in FIG. 8.

The control valve 148 is connected to the lower proximal end of a valve stem 170 which has a valve stem collar 172 on its upper distal end.

Figure 9:
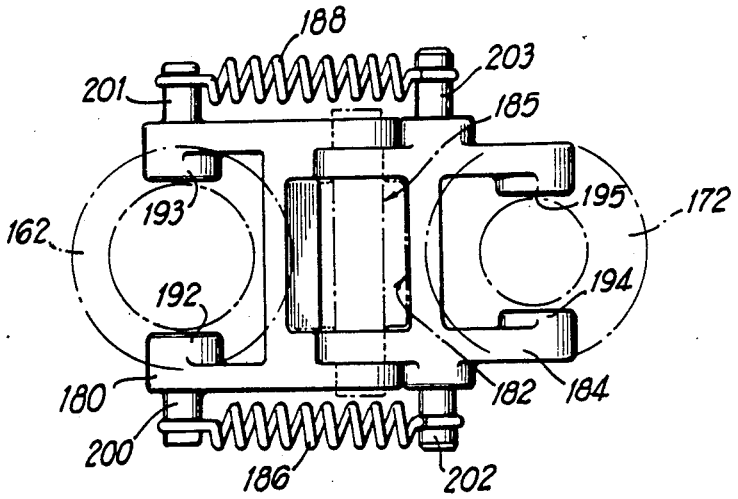
FIG. 9 is a slightly enlarged plan view of the snap-acting spring mechanism of the pump of FIG. 8 taken along line 9—9 in FIG. 8 with the long and short arms shown lined up in the same plane.

The piston assembly 150 and the control valve 148 are mechanically coupled together by an over-center, snap-acting spring mechanism 174. The spring mechanism 174 includes an upstanding post 182 which is part of the upper body 122 and which includes horizontal cylindrical bar 185 on the top thereof. A long arm 180 extends between the piston stem collar 162 and the bar 185, and a short arm 184 extends between the valve stem collar 172 and the bar 185. A pair of extension springs 186 and 188 extend between the arms 180 and 184 (as best shown in FIG. 9).

The arms 180 and 184 are each H-shaped members having internally extending cylindrical lugs 192, 193 and 194, 195, respectively, on one end of each leg and having open-ended U-shaped recesses (see recess 196 in FIG. 8) on the other end of each leg. The lugs engage the collars and the recesses engage the cylindrical bar 185. The long arm 180 has a pair of outwardly extending pins 200 and 201 opposite the lugs 192 and 193, and the short arm 184 has a pair of outwardly extending pins 203, 203 located about midway along its length. Each of these pins preferably has a circular groove to receive the spring.

Figure 10:
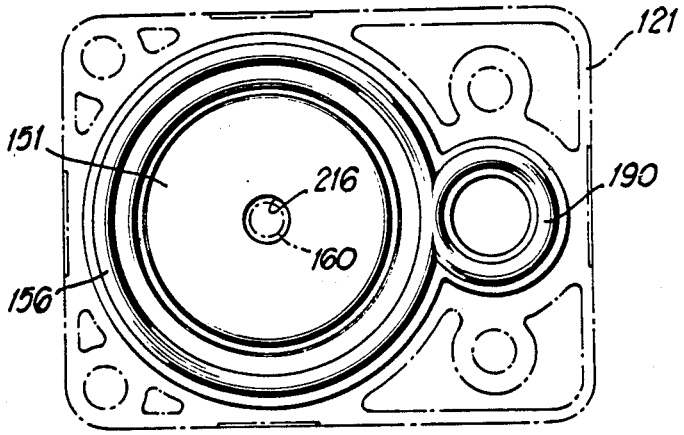
FIG. 10 is a plan view of the diaphragm assembly with the lower body shown in phantom lines, taken along line 10—10 in FIG. 8.
Figure 11:
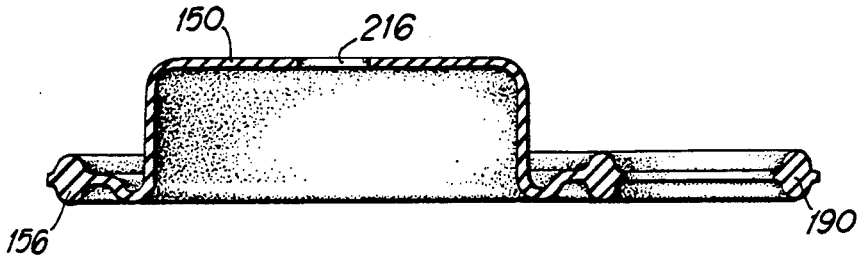
FIG. 11 is an elevational view of the diaphragm in its as-molded shape.

As shown in FIGS. 10 and 11, the diaphragm 151 is preferably formed integral with an O-ring 190 that provides a seal for the control valve chamber 141 between the upper and lower bodies 122 and 121, respectively. FIG. 11 shows the as-molded shape of the integral diaphragm 151 and O-ring 190.

Figure 12:
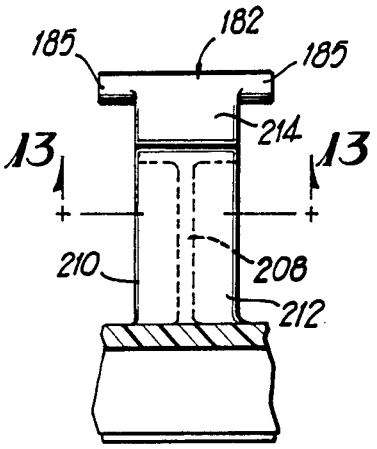
FIG. 12 is a front elevational view of the post in the pump of FIG. 8.
Figure 13:
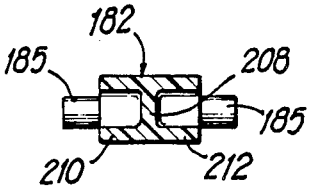
FIG. 13 is a cross-sectional view taken along line 13—13 of FIG. 12.

FIGS. 12–14 show the post 182 in more detail. The post is H-shaped in horizontal cross-section as shown in FIG. 13 and includes a pair of vertically extending U-shaped channels 210 and 212 and a central rib 208. As shown in FIG. 14, the upper portion of the post below the cylindrical bar 185 includes a solid element 214.

The operation of the pump 110 is substantially identical to that described above for the pump 10 of FIGS. 1–7. One difference in pump 110 is that there is a small amount of vertical play between the lugs 194 and 195 of the arm 184 and the collar 172 on the control valve stem 170. This provides for a stronger, more forceful snap movement of the control valve 148 from one of its two end positions to the other.

FIGS. 15–17 show a preferred embodiment of the present invention of a pump 310 similar to the pump 110 in FIGS. 8–14 except that pump 310 also includes a counteracting spring 430 for biasing the valve 348 downwardly against the inlet gas pressure. The pump 310 has a gas inlet port 312, a gas outlet port 314, a fluid outlet port 316 and a fluid outlet port 318.

The pump 310 includes a pump body 319 and a cover 320. The pump body 319 includes a lower body 321 and an upper body 322 connected together as by suitable screws (not shown).

The pump body 319 has a main chamber 328 divided by a reciprocating piston assembly 350 into a liquid pumping chamber 330 and a driving gas chamber 340. The liquid chamber 330 has an inlet port 332 controlled by a one-way umbrella valve 334 and an outlet port 336 controlled by a one-way umbrella valve 338.

The gas chamber 340 has a gas chamber port 342 in communication through a gas passageway 343 with a control valve chamber 341. The control valve chamber 341 has a gas inlet port 344, a gas exhaust port 346, and an inlet-outlet port 347 in communication with the gas chamber 340 by means of the gas passageway 343. The control valve chamber 341 has a reciprocating control valve 348 therein moveable from a first position (shown in FIG. 15) closing the gas exhaust port 346 and providing gas communication between the gas inlet port 344 and the gas chamber 340, to a second position (not shown) closing the gas inlet port 344 and providing gas flow communication between the gas exhaust port 346 and the gas chamber 340. In this embodiment, the gas exhaust port 346 opens into the inside of the cover 320 at a 90° angle to the gas outlet fitting 312 to provide a quieter operation by muffling the noise of the pump somewhat.

The piston assembly 350 includes a diaphragm 351 connected between a piston 352 and a retainer 354 and includes an annular bead 356 that seats in a pair of mating grooves in the upper and lower bodies 322 and 321, respectively. The piston 352 is connected to a piston stem 360 which has a piston stem collar 362 on its distal end. An O-ring 366 seals against the reciprocating stem 360. A compression spring 364 is positioned in the liquid pumping chamber 330 between the piston 352 and the lower body 321. An annular groove in each of the piston and lower body receives the spring 364. The spring biases the piston assembly upwardly in FIG. 15.

The control valve 348 is connected to the lower proximal end of a valve stem 370 which has a valve stem collar 372 on its upper distal end. The control valve 348 has a metal sleeve 349 to increase the life of the control valve 348.

The piston assembly 350 and the control valve 348 are mechanically coupled together by an over-center, snap-acting spring mechanism 374. The spring mechanism 374 includes an upstanding post 382 which is part of the upper body 322 and which includes horizontal cylindrical bar 385 on the top thereof. A long arm 380 extends between the piston stem collar 362 and the bar 385, and a short arm 384 extends between the valve stem collar 372 and the bar 385. A pair of extension springs 386 and 388 extend between the arms 380 and 384 (as best shown in FIGS. 15 and 16).

The arms 380 and 384 are each H-shaped members having internally extending cylindrical lugs (such as lugs 392 and 393 in FIG. 17) on one end of each leg and having open-ended U-shaped recesses (see recess 396 in FIG. 17) on the other end of each leg. The lugs engage the collars and the recesses engage the cylindrical bar 385. The long arm 380 has a pair of outwardly extending pins 400 and 401 opposite the lugs 392 and 393, and the short arm 384 has a pair of outwardly extending pins (see pin 402 in FIG. 17) opposite the lugs (see lug 403 in FIG. 17). Each of these pins preferably has a flange to hold the spring.

The diaphragm 351 is similar to diaphragm 151 shown in FIGS. 10 and 11. The diaphragm 351 is preferably formed integral with an O-ring 390 that provides a seal for the control valve chamber 341 between the upper and lower bodies 322 and 321, respectively.

The pump 310 also includes a counteracting compression spring 430 and supporting structure 432. This spring 430 helps to balance the forces on the poppet shaft 370 and allows the springs 386 and 388 to be lighter.

A combination of factors determine the forces on the poppet valve 348 as it moves up and down in the valve chamber 341. These factors are: inlet gas pressure, atmospheric pressure and the effective seat area.

The ideal situation would be for these factors to help push the poppet valve 348 up when it is seated on the upper seat and to help push it down when it is seated on the lower seat. However, this is not the case, because these factors combine to exert an upward force on the poppet valve in both positions. In fact, although we want an upward force when the poppet valve is in the top position, these factors cause too much upward force. For example, with an inlet gas pressure of 75 psig, there is a 2.07 pound force pushing the poppet valve up in the top position, and a 0.06 pound force pushing it up in the bottom position.

The magnitude of these upward forces is important when considering the purpose of the spring mechanism 374. The spring mechanism 374 holds the valve 348 in the correct position and unseats the valve at the proper time to reverse the piston 352. The spring 430 is added to exert a downward force which helps counteract the forces described above. The spring 430 exerts more force when the valve 348 is in the top position to help counteract the higher force encountered when the valve is in that position. The spring 430 allows the spring mechanism 374 to be a less expensive design that does less work. The following is a list of advantages made possible by the addition of the spring 430:

1. The pump has less tendency to stall;
2. The pump runs quieter;
3. There is less wear and shock on all of the components of the spring mechanism 374 and all the valve 348 components;
4. The spring 430 allows the springs of the spring mechanism 374 to exert less force; and
5. The pump has a higher syrup pressure output for a given gas input.

The supporting structure 432 includes an extension 440 of the post 382, and a top wall 442. The spring 430 is held in place between a lower surface of the top wall 442 and the top of the valve stem collar 372.

Another change from the embodiment of FIGS. 1–14 is the use of a metal sleeve 450 around the valve 348, to help increase the life of the valve.

The operation of the pump 310 is similar to that described above for the pump 10 of FIGS. 1–7, and for the pump 110 of FIGS. 8–14. The main difference is the counteracting spring 430 as described above.

While the present invention has been described in detail with reference to the preferred and two other embodiments thereof, it will be understood that various changes and modifications can be made therein without departing from the spirit and scope of the present invention as set forth in the appended claims. For example, different materials and shapes and sizes of the various components can be used. The locations of the ports can be moved, if desired. The types and locations of the springs can be changed. The compression spring that pushes the piston assembly can alternatively be a tension spring to pull the piston assembly, for example.

What is claimed is:

1. A method for pumping a liquid with a single-acting, gas operated pump comprising the steps of:

(a) providing a pump body including a main chamber therein separated by a reciprocatable piston means into a gas driving chamber and a liquid pumping chamber;

(b) feeding liquid one way into and out of said liquid chamber;

(c) alternately reciprocating a control valve for feeding driving gas into said driving chamber and exhausting gas therefrom to cause said piston means to reciprocate and to alternately pump liquid out of said liquid chamber and to draw liquid thereinto, respectively;

(d) biasing said piston means toward said gas driving chamber;

(e) snap-moving said single control valve from one of its two end positions to the other with a snap-acting spring mechanism coupled between said piston means and said control valve, in response to reciprocating movement of said piston means;

(f) wherein said biasing step comprises positioning a coil compression spring in said liquid chamber; and (g) including forming said pump body from only an upper body and a lower body connected together and forming said main chamber between said upper and lower bodies and forming a control valve chamber separate from said main chamber and between said upper and lower bodies, providing said gas passageway between said control valve chamber and said main chamber in said upper body and providing a single integral sealing element between said upper and lower bodies consisting of a flexible diaphragm separating said main chamber into said gas driving chamber and said liquid pumping chamber and an O-ring integral with said diaphragm for sealing said control valve chamber.

2. A single-acting, gas operated pump comprising:

(a) a pump body including a main chamber therein;

(b) piston means separating said main chamber into a gas driving chamber and a liquid pumping chamber;

(c) spring means associated with said piston means for biasing said piston means toward said gas driving chamber;

(d) means for feeding liquid one-way into and out of said liquid pumping chamber;

(e) control valve means movable back and forth between two control positions thereof for alternately feeding driving gas into said gas driving chamber and for exhausting gas therefrom to cause said piston means to reciprocate and alternately pump liquid out of said liquid chamber and draw liquid thereinto, respectively;

(f) snap-acting spring means mechanically coupling said piston means to said control valve means for snap moving said control valve means back and forth between said two control positions thereof, in response to the reciprocating movement of said piston means;

(g) said control valve means including a control valve chamber, a control valve mounted in said control valve chamber for reciprocating movement back and forth therein between first and second control positions, means for feeding gas into said control valve chamber including a gas inlet port in said control valve chamber closed by said control valve when in its second position, means for exhausting gas from said control valve chamber including a gas exhaust port in said control valve chamber closed by said control valve when in said first position, and a gas passageway between said control valve chamber and said gas driving chamber; and (h) including a single integral element for sealing said main chamber and said control valve chamber, said element consisting of a diaphragm forming part of said piston means and an O ring for sealing said control valve chamber.

3. A method for pumping a liquid with a single-acting, gas operated pump comprising the steps of:

(a) providing a pump body including a main chamber therein separated by a reciprocable piston means into a gas driving chamber and a liquid pumping chamber;

(b) feeding liquid one way into and out of said liquid chamber;

(c) alternately reciprocating a control valve for feeding driving gas into said gas driving chamber and exhausting gas therefrom to cause said piston means to reciprocate and to alternately pump liquid out of said liquid chamber and to draw liquid thereinto, respectively;

(d) biasing said piston means toward said gas driving chamber;

(e) snap-moving said control valve from one of its two end positions to the other with a snap-acting spring mechanism coupled between said piston means and said control valve, in response to reciprocating movement of said piston means; and (f) biasing said control valve toward one of its two end positions.

4. The method as recited in claim 3 including the step of positioning a cover over the snap-acting spring means and wherein said step of exhausting gas from said gas chamber comprises feeding exhaust gas into the volume inside of said cover.

5. The method as recited in claim 3 wherein said snap-moving step comprises providing a piston means stem connected to said piston means and extending exteriorly of said main chamber, wherein said alternately feeding step comprises providing said control valve reciprocatingly movable between first and second control positions and including the step of providing a control valve stem connected to said control valve and extending exteriorly of said control valve chamber, mechanically coupling said stems together with an over-center spring means, and wherein said control valve biasing step comprises providing a compression spring in contact with said control valve stem.

6. A method for pumping a liquid with a single-acting, gas operated pump comprising the steps of:

(a) providing a pump body including a main chamber therein separated by a reciprocatable piston means into a gas driving chamber and a liquid pumping chamber;

(b) feeding liquid one way into and out of said liquid chamber;

(c) alternately reciprocating a single control valve in a control valve chamber for feeding driving gas into said gas driving chamber and exhausting gas therefrom to cause said piston means to reciprocate and to alternately pump liquid out of said liquid chamber and to draw liquid thereinto, respectively;

(d) biasing said piston means toward said gas driving chamber, said biasing step including applying a force to said piston means sufficient to cause reciprocation thereof only when the pressure in said liquid pumping chamber is above approximately twenty-two inches of mercury;

(e) snap-moving said single control valve from one of its two end positions to the other with a snap-acting spring mechanism mounted outside of said main chamber and coupled between said piston means and said control valve, in response to reciprocating movement of said piston means;

(f) said snap-moving step comprising providing a piston means stem connected to said piston means and extending exteriorly of said main chamber, wherein said alternately feeding step comprises providing said single control valve reciprocatingly movable between first and second control positions and including the step of providing a control valve stem connected to said control valve and extending exteriorly of said control valve chamber, and mechanically coupling said stems together with an over-center spring means; and (g) including the steps of feeding gas into said control valve chamber through only a single gas inlet port in said control valve chamber, exhausting gas from said control valve chamber through only a single gas exhaust port in said control valve chamber, and feeding gas back and forth between said control valve chamber and said main chamber through only a single gas passageway therebetween.

7. The method as recited in claim 6 including the step of providing an amount of play between said over-center spring means and said control valve stem to provide a more forceful snap movement of said control valve stem when said over-center spring moves over-center.

8. The method as recited in claim 6 including the step of operating said pump at a rate of from about 0.5 to 15 cycles per second and dispensing about 0.25 ounces of liquid per second.

9. The method as recited in claim 6 wherein said biasing step comprises positioning a coil compression spring in said liquid chamber.

10. The method as recited in claim 9 including the step of positioning a cover over the snap-acting spring means and wherein said step of exhausting gas from said gas chamber comprises feeding exhaust gas into the volume inside of said cover.

11. A single-acting, gas operated pump comprising:

(a) a pump body including a main chamber therein;

(b) piston means separating said main chamber into a gas driving chamber and a liquid pumping chamber;

(c) spring means associated with said piston means for biasing said piston means toward said gas driving chamber;

(d) means for feeding liquid one-way into and out of said liquid pumping chamber;

(e) control valve means movable back and forth between two control positions thereof for alternately feeding driving gas into said gas driving chamber and for exhausting gas therefrom to cause said piston means to reciprocate and alternately pump liquid out of said liquid chamber and draw liquid thereinto, respectively;

(f) snap-acting spring means mechanically coupling said piston means to said control valve means for snap moving said control valve means back and forth between said two control positions thereof, in response to the reciprocating movement of said piston means;

(g) said control valve means including a control valve chamber, a control valve mounted in said control valve chamber for reciprocating movement back and forth therein between first and second control positions, means for feeding gas into said control valve chamber including a gas inlet port in said control valve chamber closed by said control valve when in its second position, means for exhausting gas from said control valve chamber including a gas exhaust port in said control valve chamber closed by said control valve when in said first position, and a gas passageway between said control valve chamber and said gas driving chamber;

(h) a reciprocating control valve stem connected to said control valve and extending exteriorly of said control valve chamber, and a reciprocating diaphragm piston means stem connected to said piston means and extending exteriorly of said main chamber, and wherein said snap-acting spring means mechanically couples said stems together;

(i) said snap-acting spring means including a stationary pivot, a first arm movably positioned between said pivot and said piston means stem, a second arm movably positioned between said pivot and said control valve stem, and over-center spring means connected at one end thereof to one of said piston means stem or said first arm, and at the other end thereof to one of said control valve stem or said second arm;

(j) said over-center spring means being connected at said other end thereof to said second arm and said second arm is connected to said control valve stem with an amount of play therebetween to provide a more forceful snapping action when said over-center spring means moves over-center;

(k) a collar connected to each of said stems, each of said collars having a pair of vertically spaced-apart horizontal flanges with an annular recess therebetween and wherein each of said first and second arms includes projections extending into a respective one of said recesses between said flanges; and (l) said snap-acting spring means including a vertical post located between said stems and wherein said pivot is a horizontal cylindrical bar located on top of said post and extending perpendicular to a vertical plane through the axes of said stems, wherein each of said arms are H-shaped and have a pair of parallel legs connected by a cross-member and including U-shaped recesses on one end of each of said pair of legs and wherein said bar is received in each of said U-shaped recesses, and wherein said over-center spring means includes a pair of coil compression springs connected between said first and second arms.

12. The pump as recited in claim 11 including a cover connected to said pump body and enclosing said snap-acting spring means and including a gas exhaust passageway therethrough and wherein said control valve means includes means for exhausting gas from said gas driving chamber into the interior of said cover.

13. The pump as recited in claim 11 wherein said second arm is mounted on said bar inside of said first arm and wherein said springs are attached to opposite sides of said arms.

14. The pump as recited in claim 13 wherein said pump body includes only lower and upper bodies connected together and providing said main chamber and said control valve chamber therebetween and wherein said liquid feeding means are located in said lower body.

15. The pump as recited in claim 14 wherein said gas inlet port is located in said lower body and wherein said gas exhaust port and said gas passageway are located in said upper body.

16. The pump as recited in claim 15 including a cover enclosing said snap-acting spring means and including a gas exhaust passageway through said cover, and wherein said gas exhaust means communicates with the space inside of said cover.

17. The pump as recited in claim 16 wherein said biasing spring means is positioned inside of said liquid pumping chamber.

18. A single-acting, gas operated pump comprising:

(a) a pump body including a main chamber therein;

(b) piston means separating said main chamber into a gas driving chamber and a liquid pumping chamber;

(c) spring means associated with said piston means for biasing said piston means toward said gas driving chamber;

(d) means for feeding liquid one-way into and out of said liquid pumping chamber;

(e) control valve means movable back and forth between two control positions thereof for alternately feeding driving gas into said gas driving chamber and for exhausting gas therefrom to cause said piston means to reciprocate and alternately pump liquid out of said liquid chamber and draw liquid thereinto, respectively;

(f) snap-acting spring means mechanically coupling said piston means to said control valve means for snap moving said control valve means back and forth between said two control positions thereof, in response to the reciprocating movement of said piston means;

(g) said control valve means includes a control valve chamber, a control valve mounted in said control valve chamber for reciprocating movement back and forth therein between first and second control positions, means for feeding gas into said control valve chamber including a gas inlet port in said control valve chamber closed by said control valve when in its second position, means for exhausting gas from said control valve chamber including a gas exhaust portion in said control valve chamber closed by said control valve when in said first position, and a gas passageway between said control valve chamber and said gas driving chamber; and (h) means for biasing said control valve toward said gas inlet port, whereby less force is required by said snap-acting spring means to move said control valve from said first to said second position.

19. The pump as recited in claim 18 including a cover enclosing said snap-acting spring means and including a gas exhaust passageway through said cover, and wherein said gas exhaust means communicates with the space inside of said cover.

20. The pump as recited in claim 18 wherein said spring means associated with said piston means is positioned inside of said liquid pumping chamber.

21. The pump as recited in claim 18 including a single integral element for sealing said main chamber and said control valve chamber, said element consisting of a diaphragm forming part of said piston means and an O-ring for sealing said control valve chamber.

22. The pump as recited in claim 18 wherein said pump body includes only lower and upper bodies connected together and providing said main chamber and said control valve chamber therebetween and wherein said liquid feeding means are located in said lower body.

23. The pump as recited in claim 22 wherein said gas inlet port is located in said lower body and wherein said gas exhaust port and said gas passageway are located in said upper body.

24. The pump as recited in claim 18 wherein said biasing means comprises a spring operatively associated with said control valve.

25. The pump as recited in claim 24 including a reciprocating control valve stem connected to said control valve and extending exteriorly of said control valve chamber, and a reciprocating diaphragm piston means stem connected to said piston means and extending exteriorly of said main chamber, wherein said snap-acting spring means mechanically couples said stems together, and wherein said biasing means comprises a compression spring connected to said control valve stem.

26. The pump as recited in claim 25 wherein said snap-acting spring means includes a stationary pivot, a first arm movably positioned between said pivot and said piston means stem, a second arm movably positioned between said pivot and said control valve stem, and over-center spring means connected at one end thereof to one of said piston means stem or said first arm, and at the other end thereof to one of said control valve stem or said second arm.

27. The pump as recited in claim 26 wherein said over-center spring means is connected at said other end thereof to said second arm and said second arm is connected to said control valve stem with an amount of play therebetween to provide a forceful snapping action when said over-center spring means moves over-center.

28. A single-acting, gas operated pump comprising:

(a) a pump body including a main chamber therein;

(b) piston means separating said main chamber into a gas driving chamber and a liquid pumping chamber;

(c) spring means associated with said piston means for biasing said piston means toward said gas driving chamber, said spring means having a spring force sufficient to cause said piston means to continue reciprocating only when the pressure in said liquid pumping chamber is above approximately twenty-two inches of mercury;

(d) means for feeding liquid one-way into and out of said liquid pumping chamber;

(e) control valve means, including a single control valve movable back and forth between two control positions thereof, for alternately feeding driving gas into said gas driving chamber and for exhausting gas therefrom to cause said piston means to reciprocate and alternately pump liquid out of said liquid chamber and draw liquid thereinto, respectively;

(f) snap-acting spring means mounted outside of said main chamber and mechanically coupling said piston means to said control valve means for snap moving said control valve means back and forth between said two control positions thereof, in response to the reciprocating movement of said piston means; and (g) said control valve means including a control valve chamber, said single control valve being mounted in said control valve chamber for reciprocating movement back and forth therein between first and second control positions, means for feeding gas into said control valve chamber including a single gas inlet port in said control valve chamber closed by said control valve when in its second position, means for exhausting gas from said control valve chamber including a single gas exhaust port in said control valve chamber closed by said control valve when in said first position, and a single gas passageway between said control valve chamber and said gas driving chamber.

29. The pump as recited in claim 28 wherein said biasing spring means is positioned inside of said liquid pumping chamber.

30. The pump as recited in claim 28 wherein said liquid feeding means includes a pair of one-way umbrella valves snapped-fitted into said pump body.

31. The pump as recited in claim 28 wherein said control valve includes an elastomeric body surrounded by a metal sleeve to increase the life of said control valve.

32. The pump as recited in claim 11 when said pump body includes only lower and upper bodies connected together and providing said main chamber therebetween and wherein said liquid feeding means are located in said lower body.

33. The pump as recited in claim 32 wherein said control valve means includes a gas passageway into said gas driving chamber, said gas passageway being located completely in said upper body and a gas exhaust passageway also being located completely in said upper body, and wherein said snap-acting spring means is connected to said upper body.

34. The pump as recited in claim 28 including a reciprocating control valve stem connected to said control valve and extending exteriorly of said control valve chamber, and a reciprocating diaphragm piston means stem connected to said piston means and extending exteriorly of said main chamber, and wherein said snap-acting spring means mechanically couples said stems together.

35. The pump as recited in claim 34 wherein said snap-acting spring means includes a stationary pivot, a first arm movably positioned between said pivot and said piston means stem, a second arm movably positioned between said pivot and said control valve stem, and over-center spring means connected at one end thereof to one of said piston means stem or said first arm, and at the other end thereof to one of said control valve stem or said second arm.

36. The pump as recited in claim 35 wherein said over-center spring means is connected at said other end thereof to said second arm and said second arm is connected to said control valve stem with an amount of play therebetween to provide a more forceful snapping action when said over-center spring means moves over-center.

37. The pump as recited in claim 36 wherein a collar is connected to each of said stems, said collar having a pair of vertically spaced-apart horizontal flanges with an annular recess therebetween and wherein each of said first and second arms includes projections extending into a respective one of said recesses between said flanges.

* * * * *